US005542817A

United States Patent [19]

Brandt

[11] Patent Number: 5,542,817

[45] Date of Patent: Aug. 6, 1996

[54] IMPELLER FOR A ROTARY PUMP

[75] Inventor: Bengt-Ake Brandt, Sundbyberg, Sweden

[73] Assignee: ITT Flygt AB, Solna, Sweden

[21] Appl. No.: 247,796

[22] Filed: May 23, 1994

[51] Int. Cl.[6] ..... F04D 1/00

[52] U.S. Cl. ..... 415/58.2; 415/106; 416/186 R

[58] Field of Search ..... 415/58.2, 58.3, 415/106, 168.1; 416/185, 185 R

[56] References Cited

U.S. PATENT DOCUMENTS

| | | | |
|---|---|---|---|
| 1,095,394 | 5/1914 | Goldman | 415/106 |
| 1,563,129 | 11/1925 | Weil | 415/106 |
| 1,610,454 | 12/1926 | Lawaczeck | 415/106 |
| 1,967,316 | 7/1934 | Meeker | 415/106 |
| 4,863,353 | 9/1989 | Manninen | 416/244 R |
| 5,156,522 | 10/1992 | Tessier | 415/58.2 |

FOREIGN PATENT DOCUMENTS

| | | | |
|---|---|---|---|
| 475711 | 4/1929 | Germany . | |
| 58/192995 | 11/1983 | Japan . | |
| 1143884 | 3/1985 | Sweden . | |
| 1326776 | 7/1987 | Sweden | 415/58.2 |
| 1751429 | 7/1992 | Sweden . | |

*Primary Examiner*—Edward K. Look
*Assistant Examiner*—James A. Larson
*Attorney, Agent, or Firm*—Menotti J. Lombardi

[57] ABSTRACT

Notches in the impeller cooperate with balancing holes therein, and a liquid-receiving slot, to direct liquid across the leading edges of impeller vanes to flush away any accreted substances therefrom. In addition, a large diameter deflector coupled to the hub of the impeller also cooperates with the notches to deflect the flushing liquid in the direction of the main liquid flow through the impeller.

3 Claims, 2 Drawing Sheets

IMPELLER FOR A ROTARY PUMP

BACKGROUND OF THE INVENTION

This invention pertains, generally, to pumps of the so-called rotodynamic type which comprise rotary impellers in pump housings, and in particular to a novel impeller for such rotary pumps, and an impeller kit therefor as well.

Rotodynamic pumps are commonly used for the pumping of sewage water, and water in some types of industrial processes which contains fibrous material. It often happens that the pumping is disturbed by rag fibers, and such, which become adhered to the leading edges of the impeller vanes and/or guide vanes. The accretion of such material on the aforesaid edges can cause the pump to vibrate, diminish the efficiency of the pump, and even cause complete clogging. It is sometimes possible to remove the accretion on the leading edges by having the impeller rotate in reverse, but this is not a satisfactory solution to the problem. Another known approach to the problem, to minimize the likelihood of pump clogging, is to provide the pump with some sort of cutting means which disintegrates the pollutants, i.e., the fibrous materials, and such, before they enter the impeller. An example of the latter approach is set forth in Swedish Patent No. 8205774-6. Notwithstanding the merits of this, it occurs that the cutting means wears out and, thereafter, the clogging problem remains.

Clearly, then, there exists a need for a more efficient means for minimizing the accretion of troublesome materials on impeller vanes, and for flushing the vanes with fluid to remove any adhering materials therefrom, and the instant invention is drawn to satisfying that need.

SUMMARY OF THE INVENTION

It is an object of this invention to set forth an impeller, for a rotary pump, comprising a vaned impeller; wherein said vaned impeller has (a) a cover disc, and (b) a hub for attachment thereof to a prime mover; and said disc has a balancing hole formed therein, for admitting fluid therethrough, and means in fluid communication with said hole for deflecting such fluid, as passes through said hole, in a given direction.

It is also an object of this invention to disclose an impeller, for a rotary pump, comprising an impeller having at least one vane thereon, a cover disc, and a hub for attachment thereof to a prime mover; wherein said one vane has a leading edge; and said disc has means for conducting fluid therethrough and directing such fluid toward said leading edge for fluid-flushing thereof.

It is a further object of this invention to set out an impeller kit, for a rotary pump, comprising a vaned impeller; wherein said impeller has (a) a cover disc, and (b) a hub for attachment thereof to a prime mover; said disc has a balancing hole formed therein for admitting fluid therethrough; and means for (a) fastening thereof in abutting engagement with said hub, and (b) positively deflecting such fluid, as passes through said hole, in a given direction.

More, it is an object of this invention to disclose an impeller kit, for a rotary pump, comprising a vaned impeller; wherein said impeller has (a) a cover disc, and (b) a hub having a drive shaft-receiving bore formed therein; said disc has a balancing hole formed therein, for admitting fluid therethrough; and means for fastening said hub to a drive shaft via said bore; and wherein said fastening means comprises means for positively deflecting such fluid, as passes through said hole, in a given direction.

BRIEF DESCRIPTION OF THE DRAWINGS

Further objects and features of the invention will become apparent by reference to the following description, taken in conjunction with the accompanying figures, in which.

DETAILED DESCRIPTION OF THE PREFERRED EMBODIMENT

Figure 1:
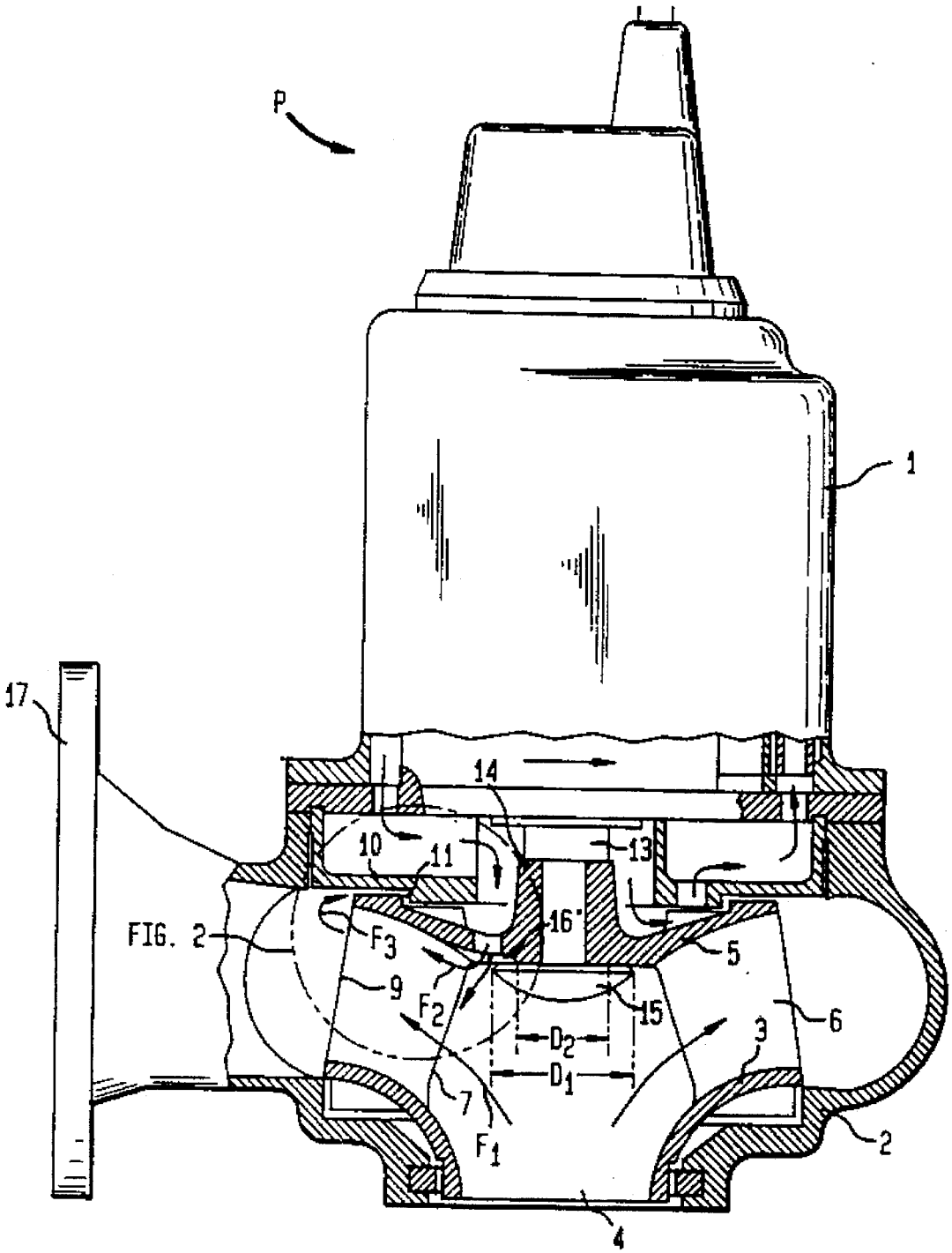
FIG. 1 is an elevational view of a centrifugal pump, partly cross-sectioned, which incorporates an embodiment of the invention.
Figure 2:
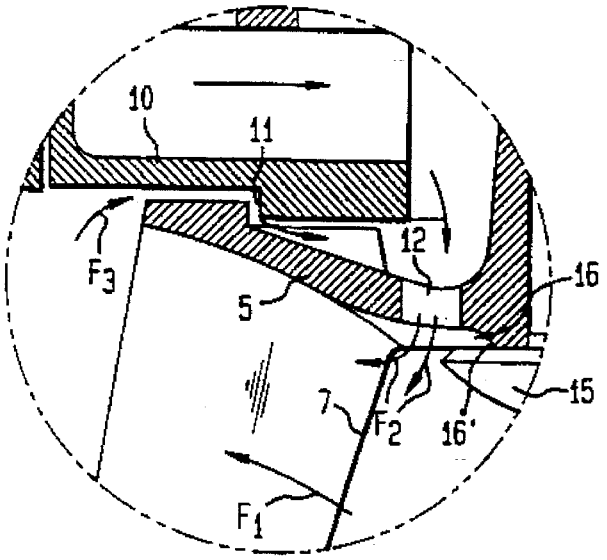
FIG. 2 is an enlargment of the detailed section, of FIG. 1, which is circled.
Figure 3:
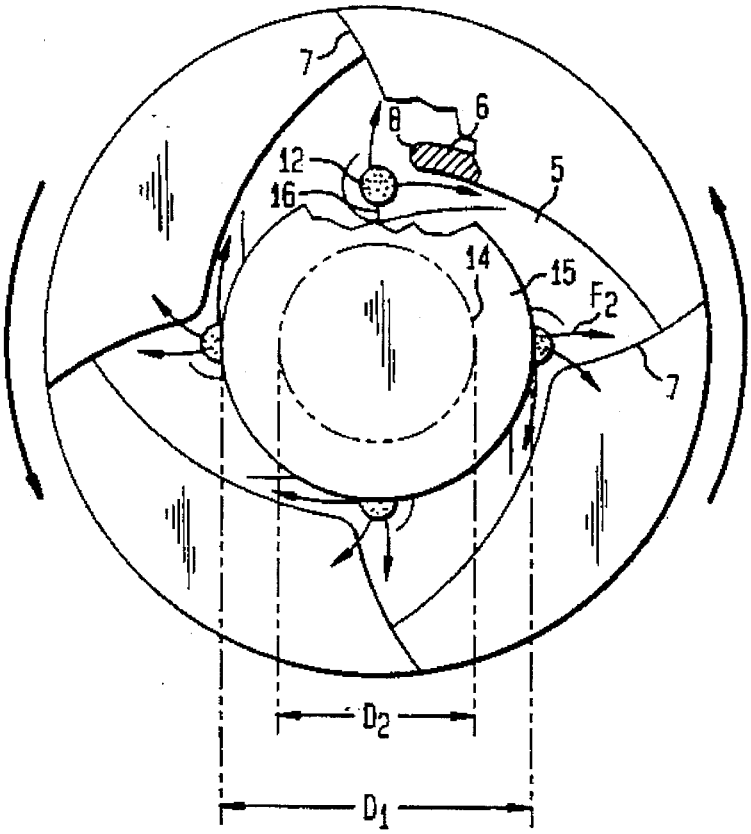
FIG. 3 is a bottom plan view of the pump of FIG. 1.

As shown in the figures, the centrifugal pump "P" has a driving unit or prime mover enclosure 1 and an impeller-confining, hydraulic unit 2, the two comprising a submersible pump for use in sewage, or the like, handling. A vaned impeller 3 is journalled in the unit 2 about the pump inlet 4. The impeller 3 has a cover disc 5 and four vanes 6. A cut-away in FIG. 3 discloses an underlying portion of a vane, to depict both its leading edge 7 and its end 8. The trailing edge 9 of a vane 6 is shown in FIG. 2. Between enclosure 1 and unit 2 is an end wall 10. A slot 11 is located between the disc 5 and the wall 10. Too, the disc 5 has four balancing holes 12 formed therein. A drive shaft 13 extends from the enclosure 1 and receives the shaft-receiving bore of the impeller hub 14 therein. The extending end of the shaft 13 is internally threaded, and it receives a headed machine screw 15 for fastening the hub 14 in place. For a purpose explained in the ensuing text, the disc 5 has four notches 16 formed therein; the notches traverse the holes 12. Finally, the pump "P" has an outlet 17. Liquid flows through the pump "P" are denoted by the arrows $F_1$, $F_2$, and $F_3$.

As is conventional, the enclosure 1 has therewithin a prime mover, such as an electric motor (not shown) for powering the shaft 13 and rotating the impeller 3. The latter draws liquid through the inlet 4 and impels it out through the outlet 17. The main flow of the liquid is shown by the arrows $F_1$.

In this embodiment, the pump "P" has four vanes 6. However, the quantity of vanes can vary. If a maximum throughput of liquid is desired, for instance as when pumping of sewage water is necessary, an impeller with a single vane would be used. However, even in such an embodiment, the problem of accretion of troublesome materials on the leading edge 7 of such a vane 6 remains.

A common problem which attends pumping operations is that there occurs an axial force which urges the impeller 3 in the direction of the pump inlet 4. This puts a stress on the shaft bearings. This problem can be solved, at least in part, by the use of the balancing holes 12 in the disc 5. Some of the pumped fluid passes through the holes 12, as denoted by the arrows $F_2$, proceeding from the region of the trailing edges 9 of the vanes, as indicated by the arrows $F_3$.

This practice of using balancing holes 12 is already known, and the efficiency thereof, in balancing the axial urging of the impeller 3 can be modulated by the size and resultant area of the holes 12.

The liquid which passes through the holes 12 is relatively clean, for being drawn from the uppermost area of the unit 2; heavier pollutants are more likely to gravitate toward the lowermost area of the unit 2. Consequently, this liquid is not readily susceptible to clogging the relatively narrow holes 12. As noted, the subject liquid passes through the narrow slot 11 located between the wall 10 and the disc 5, as represented by the arrow $F_3$. This relatively clean liquid can be passed through channels provided therefor in the enclosure 1 for the purpose of cooling the prime mover therein.

While the use of balancing holes is a well known practice, according to the invention the holes 12 are so positioned that they direct the throughput liquid toward the ends 8 of the leading edges 7 of the vanes 6 to dislodge accretions therefrom. Accordingly, a flushing liquid flow addresses the leading edge 7 of each vane 6. Too, as there are four vanes 6, in this embodiment, there are four of the especially located holes 12.

In the prior art practice of the use of balancing holes, it is typical for the holes to discharge the liquid therethrough in a direction which is essentially opposite to, or counter to the main flow, $F_1$, through the impeller 3. Obviously, this has the effect of diminishing the efficiency of the impeller. The invention addresses this matter by deflecting the through-hole fluid flow to conformity with the aforesaid main flow direction. The notches 16, earlier noted, are formed in the disc 5 across the inboard ends of the holes 12. Too, the innermost ends 16' of the notches 16 are arcuately formed, ends 16' defining a lower portion of the hub 14, and turn the liquid in the direction of the main flow $F_1$. Nor is that all that deflects the through-hole liquid outwardly. It can be seen that the machine screw 15 has a notably large head. Its diameter, in fact, is larger than the greatest diameter of the hub 14, the former being shown as "$D_1$", and the latter as "$D_2$". The outwardly extending head of the screw 15 cooperates with the notches 16 to define a closed pocket which deflects the liquid outwardly in the direction of the outlet 17.

While I have described my invention in connection with a specific embodiment thereof, it is to be clearly understood that this is done only by way of example, and not as a limitation to the scope of the invention, as set forth in the objects thereof and in the appended claims.

I claim:

1. An impeller kit, for a rotary pump, comprising:

a vaned impeller; wherein said impeller has (a) a cover disc, and (b) a hub having a drive shaft-receiving bore formed therein;

said disc has a balancing hole formed therein, for admitting fluid therethrough; and means for fastening said hub to a drive shaft via said bore; and wherein said hub fastening means comprises means for positively deflecting said fluid, as passes through said hole, in a given direction; and said hub fastening means comprises a machine screw;

said hub has a given, greatest diameter; and said machine screw has a head with a diameter greater than said given diameter.

2. An impeller, for a rotary pump, comprising:

a vaned impeller; wherein said vaned impeller has (a) a cover disc, and (b) a hub for attachment thereof to a prime mover;

said disc has a balancing hole formed therein, for admitting fluid therethrough, and means in fluid communication with said hole for deflecting said fluid, as passes through said hole, in a given direction; said means comprises a notch, formed in said disc, which crosses said balancing hole, and said notch, at one end thereof, extends to said hub.

3. An impeller, according to claim 2 wherein:

said one end of said notch is of arcuate formation.

* * * * *